US005726661A

United States Patent [19]

Fuji

[11] Patent Number: 5,726,661

[45] Date of Patent: Mar. 10, 1998

[54] METHOD AND APPARATUS FOR INITIAL POINTING OF AN ANTENNA

[75] Inventor: Tsuyoshi Fuji, Tokyo, Japan

[73] Assignee: Mitsubishi Denki Kabushiki Kaisha, Tokyo, Japan

[21] Appl. No.: 695,958

[22] Filed: Aug. 13, 1996

[30] Foreign Application Priority Data

Nov. 30, 1995 [JP] Japan ..... 7-312500

[51] Int. Cl.[6] ..... H01Q 3/00

[52] U.S. Cl. ..... 342/359; 342/75

[58] Field of Search ..... 342/74, 77, 422, 342/426, 359, 75

[56] References Cited

U.S. PATENT DOCUMENTS

| | | | |
|---|---|---|---|
| 4,675,680 | 6/1987 | Mori | 342/352 |
| 4,979,170 | 12/1990 | Gilhousen et al. | 370/104.1 |
| 5,347,286 | 9/1994 | Babitch | 342/359 |
| 5,450,395 | 9/1995 | Hostetter et al. | 370/18 |
| 5,561,431 | 10/1996 | Channey et al. | 342/359 |

FOREIGN PATENT DOCUMENTS 5164829 6/1993 Japan .

*Primary Examiner*—Thomas H. Tarcza
*Assistant Examiner*—Dao L. Phan
*Attorney, Agent, or Firm*—Rothwell, Figg, Ernst & Kurz

[57] ABSTRACT

A method and apparatus for pointing a tracking antenna to a communication satellite in the initial stage of satellite tracking by means of frequency shifting, upon reception of a carrier wave having deviation from the accepted standards of frequency, the antenna initial pointing apparatus including a downconverter for converting a signal received at a directive antenna to an IF signal, a synthesizer for providing the downconverter with a local signal for the IF signal conversion, a power detector for detecting the power of the IF signal, and a controller for controlling the synthesizer to generate the local signal and also for controlling the rotation of the directtive antenna. Based on a detected result from the power detector, a downconverted IF signal having deviation from the accepted standards of frequency is further converted to be included within a limited bandwidth of the power detector by means of frequency shifting.

12 Claims, 9 Drawing Sheets

METHOD AND APPARATUS FOR INITIAL POINTING OF AN ANTENNA

BACKGROUND OF THE INVENTION

1. Field of the Invention

The present invention relates to antenna pointing and more specifically to antenna pointing implemented in the initial stage of satellite tracking in mobile satellite communications, the inventive antenna initial pointing involving downconversion or frequency shifting of an IF signal upon reception of a carrier wave having deviation from accepted standards of frequency.

2. Discussion of the Conventional Art

Generally in mobile satellite communications, an antenna employed for tracking is horizontally directed and set at an optimal elevation angle to capture a spot beam of signal of some several thousand kilo-bits per second propagated from a marked satellite. Antenna initial pointing is a vital part of mobile satellite communications requiring precision and stability of antenna pointing to a marked satellite for satellite tracking.

FIG. 11 shows a block diagram of a conventional antenna initial pointing apparatus disclosed in Japanese Unexamined patent publication No. HEI5-164829. Referring to the figure, an antenna controller 2 controls an antenna rotary motor 1 to rotate a horizontally directed antenna 3. Antenna controller 2 gives antenna rotary motor 1 an angular control signal θ so that antenna 3 rotates at a constant angular speed. A received signal during rotation of antenna 3 is provided for angular detection and synchronous detection for antenna initial pointing before satellite tracking. The angular detection includes a power detector 4 for detecting the amount of power of the received signal, a mean-power detector 5 for averaging the outputs of power detector 4, and a MAX-power detector 6 for detecting a maximum power and its corresponding angle from among the outputs of mean-power detector 5. The synchronous detection includes a demodulator 7 for demodulating the received signal, and a sync detector 8 for detecting the synchronization of a demodulated signal. Results from the angular detection and the synchronous detection are inputted to antenna controller 2 for controlling the antenna rotation.

FIG. 12 shows a flowchart illustrating the operating sequence of initial antenna pointing according to the conventional antenna initial pointing apparatus of FIG. 11. Referring to the figure, antenna 3 rotates in a full circle of 360 degrees horizontally at a fixed elevation angle for maximum power detection in an angular sweep and receives the satellite signal of some several thousand kilo-bits per second. Mean-power detector 5 normally collects some several hundreds of detected results from power detector 4 as an averaging unit to average or calculate the mean value of the detected power. MAX-power detector 6 collects averaged results or mean values from mean-power detector 5 and detects a maximum power from among them to identify the corresponding angle $\theta_{MAX}$ as the maximum power angle. Antenna controller 2 receives the maximum power angular information and also synchronous information through synchronous detection by demodulator 7 and sync detector 8. Antenna controller 2 controls antenna 3 to point to a marked satellite at an angle designated by $\theta_{MAX}$ for satellite tracking only with the detected received signal having the maximum power. This terminates the conventional initial antenna pointing. With a negative result from synchronous detection, however, that is, when no maximum power angle is detected, the operating sequence is repeated from the beginning.

A difficulty encountered with the conventional initial antenna pointing technique is caused by the limited band with of the power detecting apparatus. The power detector is provided with a relatively narrow band-pass filtering property, which blocks signals having deviations from the set band width, thus allowing no opportunity for maximum power detection for such signals. Such a limited band width of the power detector causes endless cycling of initial antenna pointing upon reception of a deviated signal. This leads to the failure of antenna initial pointing and satellite tracking.

SUMMARY OF THE INVENTION

The present invention is directed to solving the problem discussed with respect to the limited performance of prior art power detection and provides a method and apparatus of antenna initial pointing which allows a signal deviating from the set frequency band width to provide an opportunity for maximum power detection by means of frequency shifting in order to provide a precise and stable antenna initial pointing in a limited time with constant energy saving.

This and other objects are accomplished by the present invention as hereinafter described in further detail.

According to one aspect of the present invention, an antenna initial pointing apparatus comprises a directionally adjustable antenna for being pointed at a communication satellite; a synthesizer for directing a local signal of a first frequency so that a receive signal at the directive antenna is downconverted into an intermediate frequency (IF) signal; a power detector for detecting a power level of the IF signal; and a controller for controlling the synthesizer to generate the local signal in a second frequency displaced in frequency from the first frequency in response to the power detector failing to detect the power, and for controlling the pointing of the directive antenna.

According to another aspect of the present invention, an antenna initial pointing method having a power detector for detecting an optimal reception level of power within a predetermined bandwidth of an intermediate frequency signal downconverted from a receive signal at an antenna based on a local signal, and a controller for controlling antenna pointing and for controlling the local signal in case of failing to detect the optimal reception level, the method comprises the steps of setting a first frequency of the local signal and rotating the antenna for detecting the optimal reception level; setting a second frequency of the local signal lower than the first frequency setting and rotating the antenna for detecting the optimal reception level in case of a failure to detect the optimal reception level in the first frequency setting; and setting a third frequency of the local signal higher than 5 the first frequency setting and rotating the antenna for detecting the optimal reception level in case of a failure to detect the optimal reception level in the first frequency setting.

BRIEF DESCRIPTION OF THE DRAWINGS

For a fuller understanding of the nature and objects of the present invention, reference should be made to the following detailed description and the accompanying drawings, in which.

DESCRIPTION OF THE PREFERRED EMBODIMENTS

Figure 1:
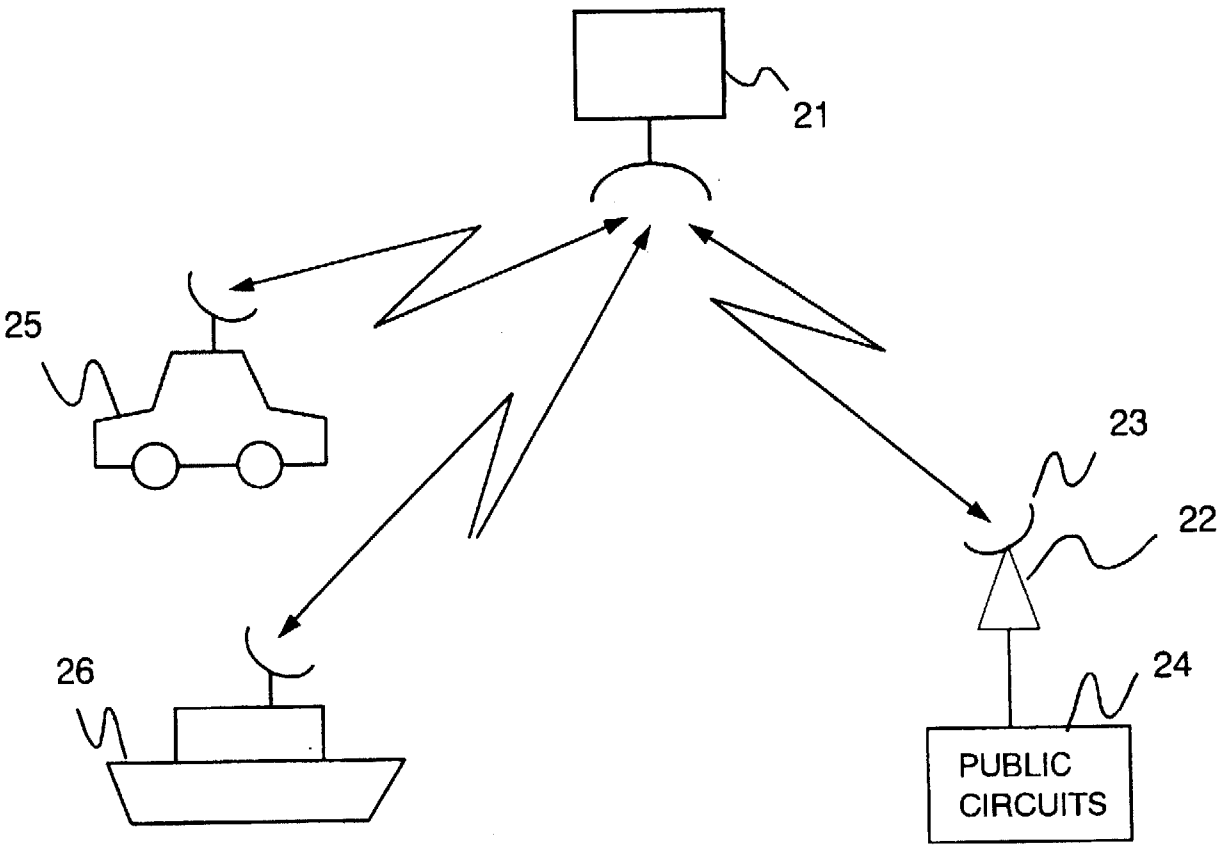
FIG. 1 shows an overall mobile radio satellite communication system involving a method and apparatus of antenna initial pointing according to the present invention.

Reference will now be made in detail to the present preferred embodiments of the invention, examples of which are illustrated in the accompanying drawings, wherein like reference numerals indicate like elements throughout the several views.

Embodiment 1.

FIG. 1 outlines a satellite communication system using a space satellite as the intermediate point between two earth-based stations involving tracking antennas. Referring to the FIG, a communications satellite 21 as a relay station for signals receives a signal from a transmitting base station 22 on the ground by way of a tracking antenna 23 equipped with an inventive antenna initial pointing apparatus according to a first embodiment of the present invention. Communication satellite 21 then retransmits the received signal to a receiving station or a mobile terminal in mobile satellite communications such as a vehicle 25 and a vessel 26 moving in an area remote from base station 22. Tracking antenna 23 is equipped with the inventive antenna initial pointing apparatus of the present invention. Base station 22 is connected to public networks by way of public circuits 24.

Figure 2:
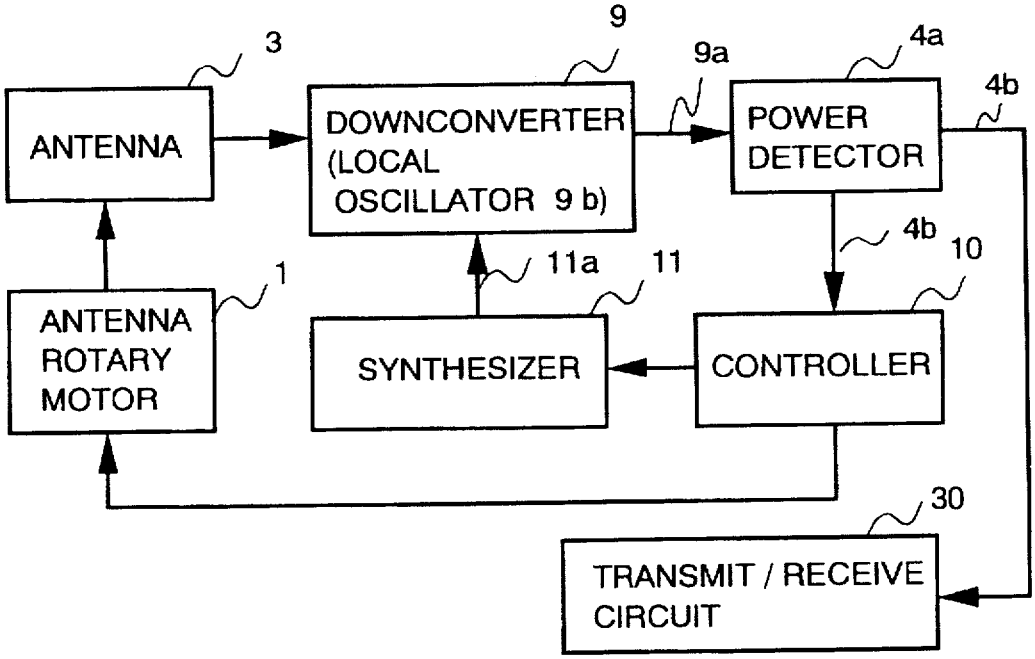
FIG. 2 shows a block diagram of antenna initial pointing apparatus according to a first embodiment of the present invention.

FIG. 2 shows a simplified block diagram of tracking antenna 23 equipped with the inventive antenna initial pointing apparatus carried on vehicle 25 of FIG. 1. Referring to the FIG, tracking antenna 3 is horizontally directed and designed to receive a spot beam from a marked communication satellite and fixed at an optimal elevation angle with respect to the horizon in a satellite direction. A downconverter 9 downconverts the received signal of the spot beam from directive antenna 3 into an intermediate frequency (IF) signal 9a. The downconversion is controlled by an adjustable local oscillator frequency generated by a local oscillator 9b provided in downconverter 9 so that the output IF frequency of downconverter 9 can be maintained within the bandwidth BW of a power detector 4a. That is, the frequency $f_l$ of the received signal is converted to an IF frequency which can be controlled by the adjustable local oscillator frequency so that the output IF frequency of the downconverter can be maintained within the bandwidth BW of the power detector 4a. For example, assume that the nominal frequency $f_1$ is 1.5 GHz (±5.7 KHz). Assume also that the local oscillator frequency $f_0$ is 1.499541 GHz for the nominal case of $f_1$=1.5 GHz to yield an IF frequency of 459 KHz. Then if $f_1$ deviates 1.500005 GHz, the local oscillator frequency $f_0$ is adjusted to 1.499546 GHz for the second scan to once again yield the correct IF frequency of 459 KHz. In this example, the IF frequency remains the same and the frequency of the local oscillator is adjusted to maintain the same IF frequency for a deviation in the frequency of the received signal $f_1$. Power detector 4a detects the power of the IF signal 9a and outputs power detection signals 4b. A controller 10 controls antenna rotary motor 1 in response to a control signal (not shown) to rotate directive antenna 3. A synthesizer 11 generates a local signal 11a for controlling local oscillator 9b or the downconversion based on an output result 4b from power detector 4a transmitted through controller 10. The local signal 11a controls the downconversion of a signal by downconverter 9. The detected result 4bfrom power detector 4a is also sent to transmit/receive circuit 30 for radio communications in the mobile satellite communication system of FIG. 1.

Figure 3:
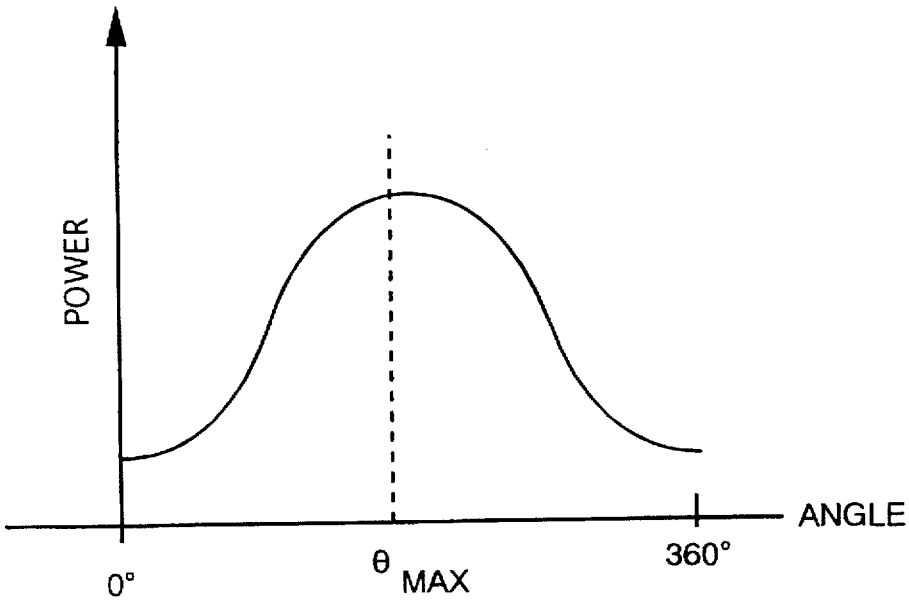
FIG. 3 shows a power-angle chart illustrating a detected result of an IF signal having no deviation from the accepted standards of frequency by a power detector of the antenna initial pointing apparatus of FIG. 2 and otherwise of an IF signal having deviation from the accepted standards of frequency processed through the frequency shifting of the present invention.

With further reference to FIG. 2, the operation of the inventive antenna initial pointing begins with controller 10 controlling antenna rotary motor 1 to rotate antenna 3 through a first 360-degree rotation in an initial scan. Received signals during the first 360-degree antenna rotation are inputted to power detector 4a for power detection. Controller 10 calculates the averages of the mean power of the outputs 4b from power detector 4a by averaging several to dozens of bits for a maximum power detection to identify the corresponding angle designated by an angular signal $\theta_{MAX}$ at which maximum power is detected. Where $\theta_{MAX}$ is determined for a received signal having no deviation from the accepted standards of frequency within the bandwidth of power detector 4a, controller 10 controls antenna rotary motor 1 to point antenna 3 to a marked satellite at the desired angle designated by $\theta_{MAX}$ after the first 360-degree antenna rotation. FIG. 3 shows a power-angle chart of a received signal having no deviation from the accepted standards of frequency, illustrating a power-angle curve including a maximum power at an angle designated by $\theta_{MAX}$.

The $\theta_{MAX}$ identification brings the normal course of antenna initial pointing to an end followed by satellite tracking.

Figure 4:
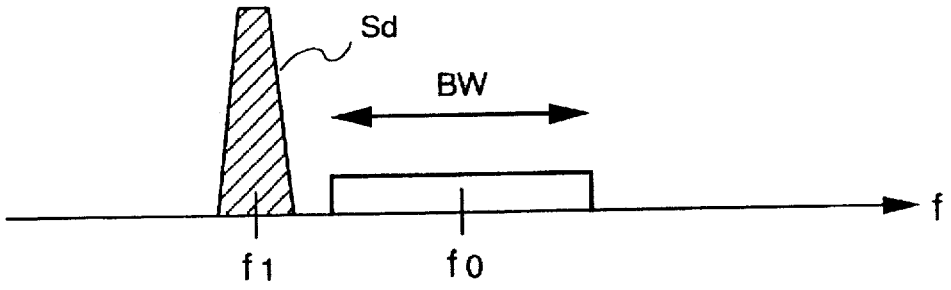
FIG. 4 shows a frequency spectrum chart of the deviated IF signal of FIG. 3 out of the bandwidth of power detector before the inventive frequency shifting.
Figure 5:
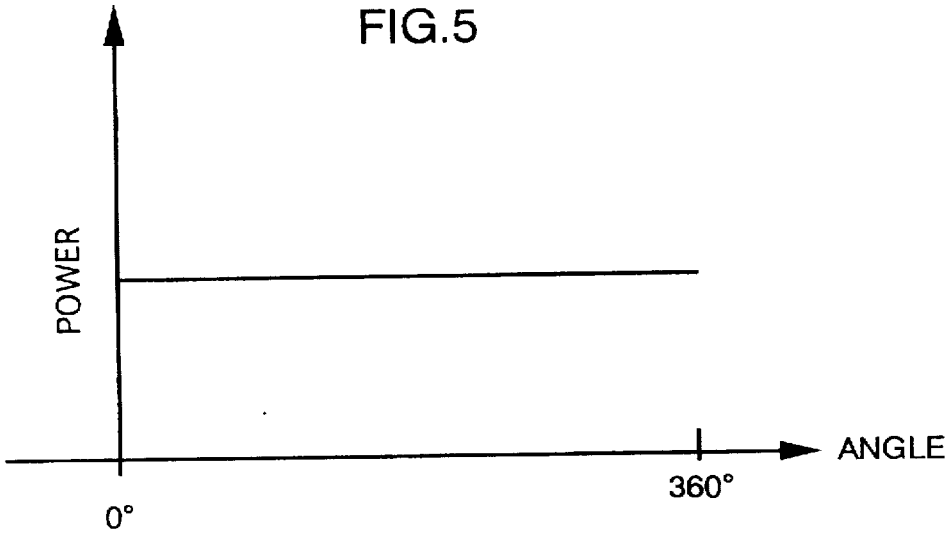
FIG. 5 shows a power-angle chart illustrating a detected result of the deviated IF signal of FIG. 4.

However, the power-angle curve of FIG. 3 is not initially detected in the case of a signal having deviation from the accepted frequency standard. The deviated signal cannot be filtered through the relatively narrow band-pass filter of power detector 4a and there is thus no identification of $\theta_{MAX}$ in the initial scan. Power detector 4a is assigned a relatively narrow bandwidth in order to protect satellite communications by eliminating noise effects caused by disturbing signals from conventional satellites. FIG. 4 shows a frequency spectrum chart of the deviated IF signal Sd with relation to the bandwidth of power detector 4a. Referring to the FIG, a frequency $f_1$ of a downconverted IF signal Sd is out of the bandwidth BW of 5 KHz, for example, having a center frequency $f_0$ of 459 KHz. The accepted amount of deviation from the standard of frequency in this case may be assumed ±5.7 KHz maximum with a received signal having a frequency range of 1.5 GHz, for example, in view of keeping synthesizer 11 stable according to this embodiment. FIG. 5 shows a power-angle chart of a scan for the deviated IF signal Sd illustrating a failing power-angle curve with a maximum power detection having no peak.

In response to such a failure in maximum power detection in the initial scan, the frequency of the deviated received signal is downconverted so as to be included within the bandwidth BW of power detector 4a by means of the inventive frequency shifting of the present invention. The inventive frequency shifting involves controller 10 for controlling synthesizer 11 to generate the local signal in order to control the downconversion of an IF signal output from downconverter 9 based on a previous result of maximum power detection through the first 360-degree antenna rotation. The frequency shifting allows the deviated IF signal Sd to fall within the bandwidth BW of power detector 4a. After the frequency shifting, antenna 3 has an additional 360-degree rotation or a second scan for maximum power detection.

Figure 6:
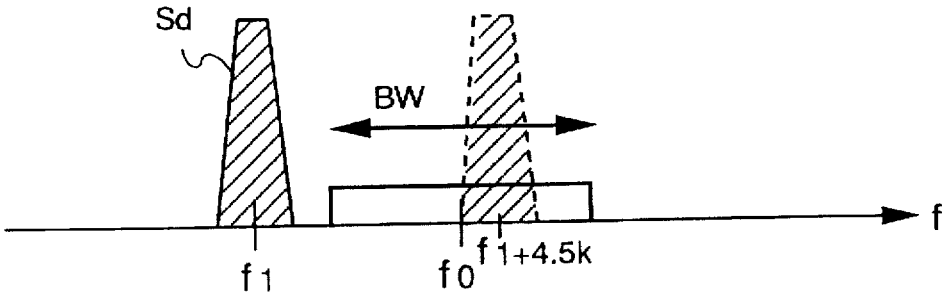
FIG. 6 shows a frequency spectrum chart of the deviated IF signal of FIG. 4 within the bandwidth of power detector after the inventive frequency shifting.

FIG. 6 shows a frequency spectrum chart of the deviated IF signal Sd included within bandwidth BW of power detector 4a illustrating the inventive frequency shifting discussed above. Referring to the figure, the center frequency $f_1$ of downconverted IF signal Sd of FIG. 4 is shifted by 4.5 KHz ($f_0-f_1$=4.5 KHz) from the center frequency $f_1$ to a shifted frequency ($f_1$+, 4.5 KHz) so that the deviated IF signal falls within bandwidth BW. Similar characteristics to those of the power-angle curve of FIG. 3 then apply to the deviated received signal of FIG. 6 including a maximum power at an angle designated by θ.

The maximum power detection including the 360-degree antenna rotation may be repeated involving the inventive frequency shifting depending upon determining elements of the amount of deviation from the accepted standards of frequency of a received signal and the filtering capacity of bandwidth of power detector 4a. With a received signal having the amount of deviation $f_0$±3/2 BW, for example, three scans of the 360-degree antenna rotation are required maximum for maximum power detection including an initial scan with the nominal frequency $f_0$, a second/third scan with a lower shifted frequency $f_{31}$,=$f_0$−BW and/or a higher shifted frequency $f_{30}$=$f_0$ BW by shifting the center frequency $f_1$ by an optimal and desired distance so that the deviated signal Sd is captured within the span of bandwidth BW. In this case, the 360-degree antenna rotation is repeated twice for maximum power detection after the first rotation with the original local oscillator center frequency $f_0$.

Figure 7A:
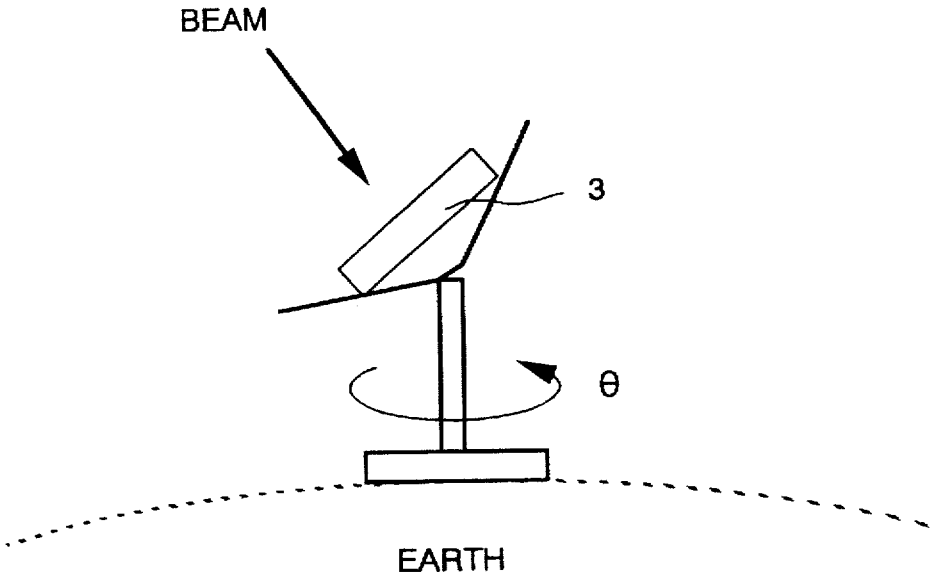
FIG. 7A shows the horizontally directive antenna of FIG. 2 at a fixed elevation angle, pointing to a marked satellite receiving a satellite spot beam at a desirable angle with relation to the 360-degree antenna rotation.

FIG. 7A shows directive antenna 3 pointing to a satellite spot beam at a desirable angle designated by $\theta_{MAX}$ corresponding to a detected maximum power of a received signal in synchronization Through the 360-degree antenna rotation. Referring to the figure, directive antenna 3 is fixed at an elevation angle measured with respect to the horizon in a satellite direction for a precise and stable pointing at a marked communication satellite.

Figure 7B:
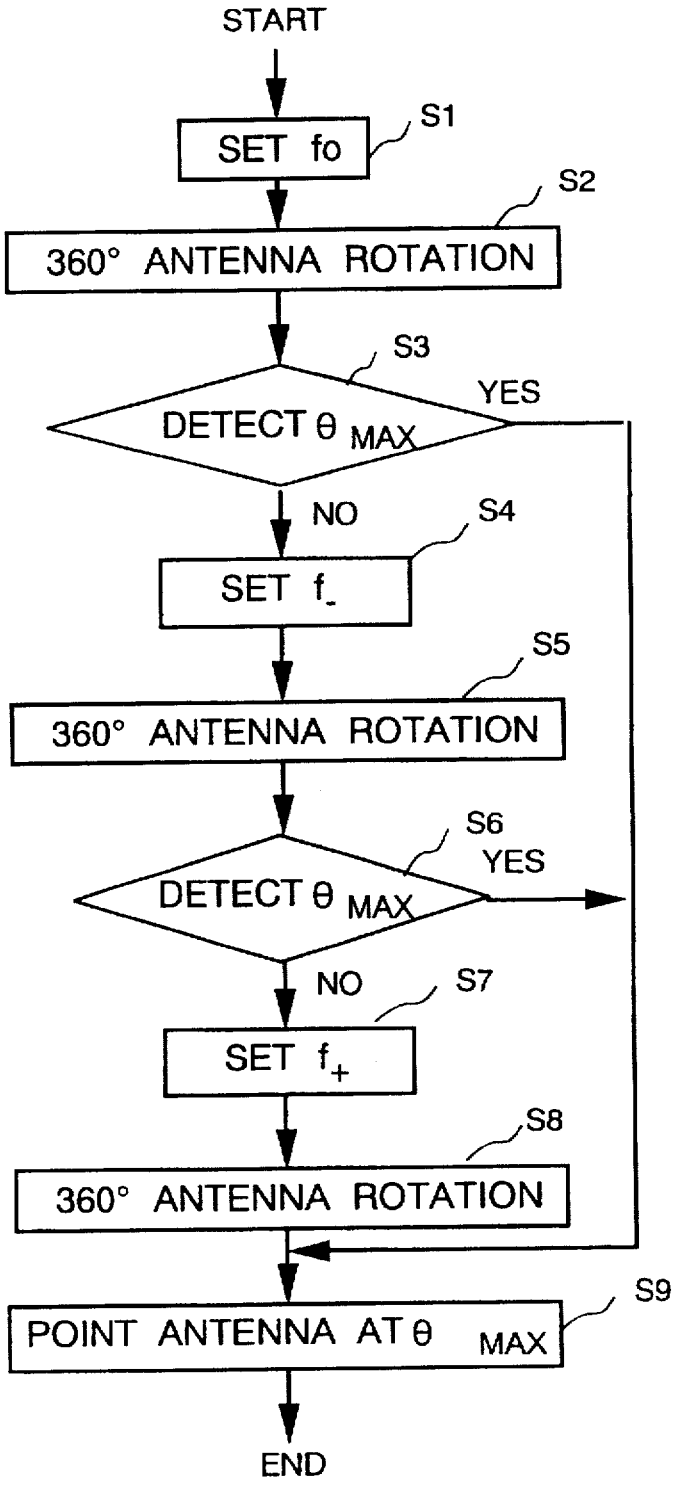
FIG. 7B shows a flowchart illustrating an operating sequence of antenna initial pointing according to the first embodiment.

FIG. 7B is a flowchart illustrating a general operating sequence of antenna initial pointing according to this embodiment. Referring to the FIG, antenna 3 is controlled to make a first 360-degree rotation in a step S2 for maximum power detection with the center frequency of an IF signal output from downconverter 9 set to a nominal value $f_0$ in a step S1. Usually with a received signal within bandwidth BW of power detector 4a, a maximum power is detected in a step S3 through the first 360-degree antenna rotation, which completes the antenna initial pointing after pointing antenna 3 at the corresponding estimated angle designated by $\theta f_0$ MAX in step S9.

With a received signal having deviation out of bandwidth BW, however, the first 360-degree antenna rotation fails to detect a maximum power in S3 and the center frequency is reset to lower value $f_-$, for example, shifted lower by an optimal distance from nominal value $f_0$ by means of the inventive frequency shifting in step S4 controlled by the local oscillator frequency and local signal $\mathbf{11}_a$ controlled by controller 10. Another maximum power detection including the 360-degree antenna rotation follows in steps S5 and S6 involving the frequency shifting. If the additional 360-degree antenna rotation still fails to detect a maximum power in S6, the frequency shifting is made with a higher value $f_+$ in step S7 followed by another maximum power detection including antenna rotation in steps S8 and S9. This should detect a maximum power after two additional 360-degree antenna rotations and normally end the whole course of antenna initial pointing.

Figure 8:
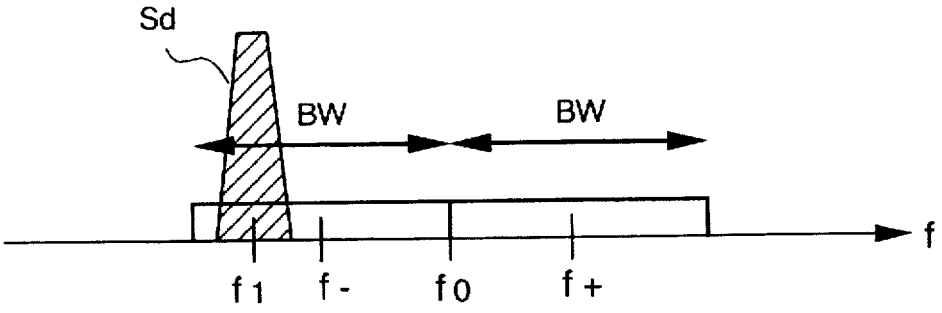
FIG. 8 shows a frequency spectrum chart of the deviated IF signal of FIG. 4 within a double span of bandwidth of power detector by means of the inventive frequency shifting.

However, the first 360-degree antenna rotation including steps S1 through S3 of FIG. 7B may be omitted if a received signal is predicted to be deviated by an estimated. In this case, the operating steps of FIG. 7B may begin with a setting of lower or higher value, $f_-$ or $f_+$ of center frequency in S4 or S7 followed by the 360-degree antenna rotation. This achieves an efficient antenna initial pointing with least efforts in time and energy. FIG. 8 shows a frequency spectrum chart of the deviated IF signal of FIG. 4 within a double span of bandwidth of power detector by means of the inventive frequency shifting with lower and higher values of the center frequency $f_-$ and $f_+$ by an optimal distance of 2.25 KHz each from nominal value $f_0$ (459 KHz) illustrating the above discussion.

This embodiment may apply to antenna initial pointing not only with continuous waves but also with pasted waves when received in an optimal receive condition. With pasted waves a sample and hold technique or an integration circuit for averaging may additionally be implemented.

This embodiment thus achieves a desirable antenna initial pointing with a noise sensitive power detector having a limited property of filtering for precise and stable reception of signals, especially, with carrier waves having deviation from the accepted standards of frequency, which is optimal to mobile radio satellite communications.

Embodiment 2.

Slower rotation of antenna than the setting speed of synthesizer or the detection speed of power detector in antenna initial pointing may, however, result in longer time and higher energy use. A second embodiment of the present invention addresses this aspect and is optimal to any type of antenna irrespective of its rotation speed in order to achieve a desirable performance of antenna initial pointing. The frequency shifting for maximum power detection discussed in the previous embodiment is employed here using the same apparatus as that of FIG. 2 with a different process of power detection involving a 360-degree antenna rotation only. A set of the inventive frequency shifting and power detection is performed at each angle by a predetermined angular distance through a cycle of the 360-degree antenna rotation.

Figure 9:
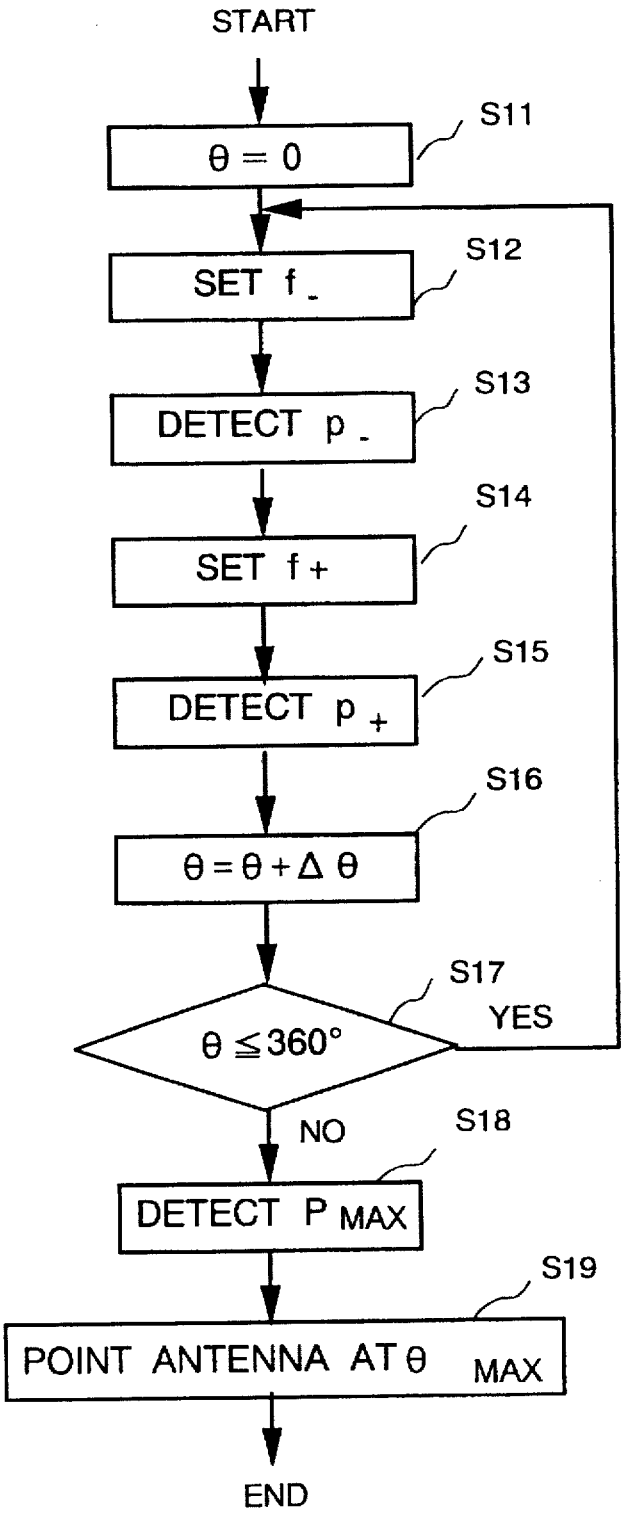
FIG. 9 shows a flowchart illustrating an operating sequence of antenna initial pointing according to a second embodiment of the present invention.

FIG. 9 shows a flowchart illustrating an operating sequence of antenna initial pointing according to this embodiment. Referring to the figure, the operating sequence begins with a commencement angle zero $\theta=0$ for power detection in step S11, where an initial series of frequency based scans for power detection is made involving the inventive frequency shifting through steps S12 and S15. In S12, a power detection is made, for example, with a lower value $f_0$ −2.2 KHz for f_ to detect a power P_ in S13, and in step S14 with a higher value $f_0$ +2.2 KHz for $f_+$ to detect a power $P_+$ in S15. After the initial series of frequency based scans for power detection, a second angle $\theta=0+\Delta\theta$ is set by a predetermined angular distance $\Delta\theta$ in step S16 for a second series of the frequency based scans. The series of frequency based scans is repeated in that manner through out the 360-degree antenna rotation to collect power detection results. A maximum power $P_{MAX}$ and a corresponding angle $\theta_{MAX}$ is then identified in steps S18 and S19, respectively, which terminates the whole course of antenna initial pointing operation according to this embodiment.

Embodiment 3.

Figure 10:
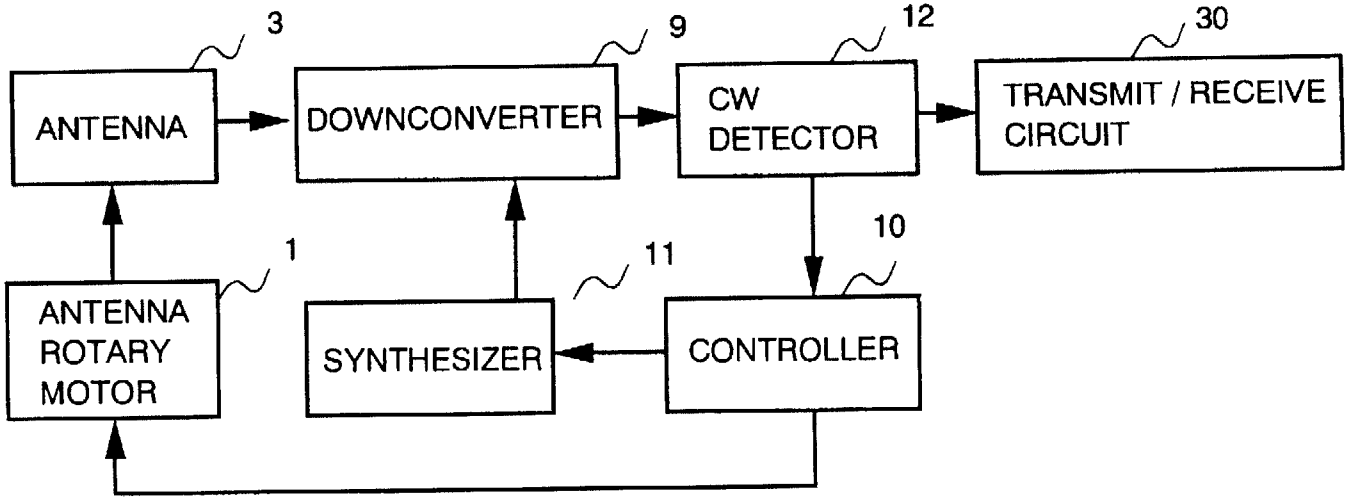
FIG. 10 shows a block diagram of antenna initial pointing apparatus according to a third embodiment of the present invention.
Figure 11:
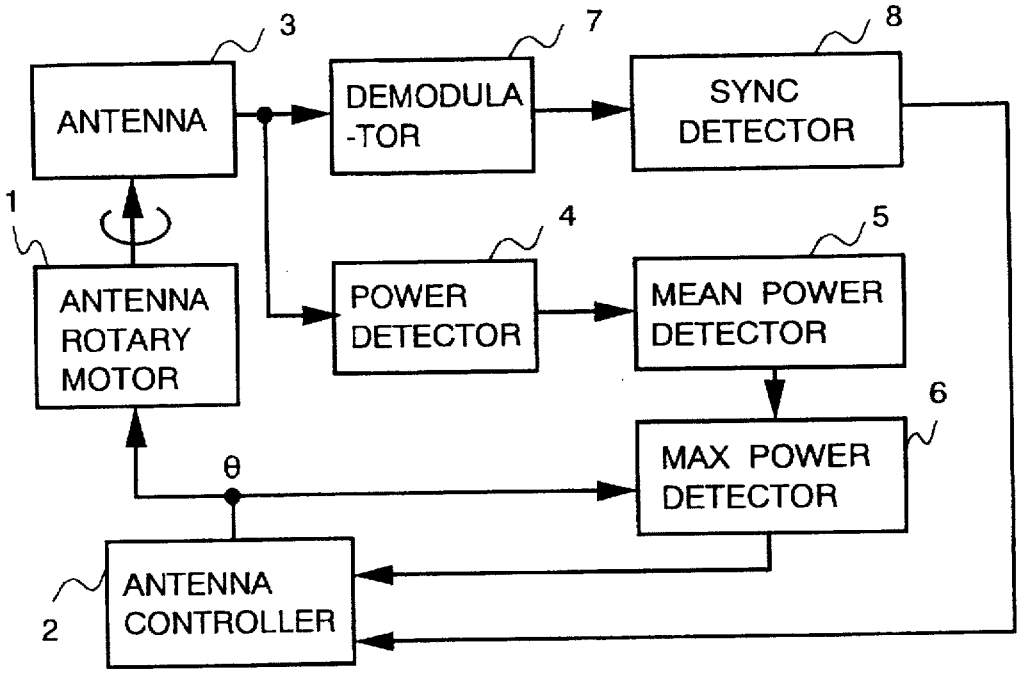
Fig.11 CONVENTIONAL ART
FIG. 11 shows a block diagram of conventional antenna pointing apparatus.
Figure 12:
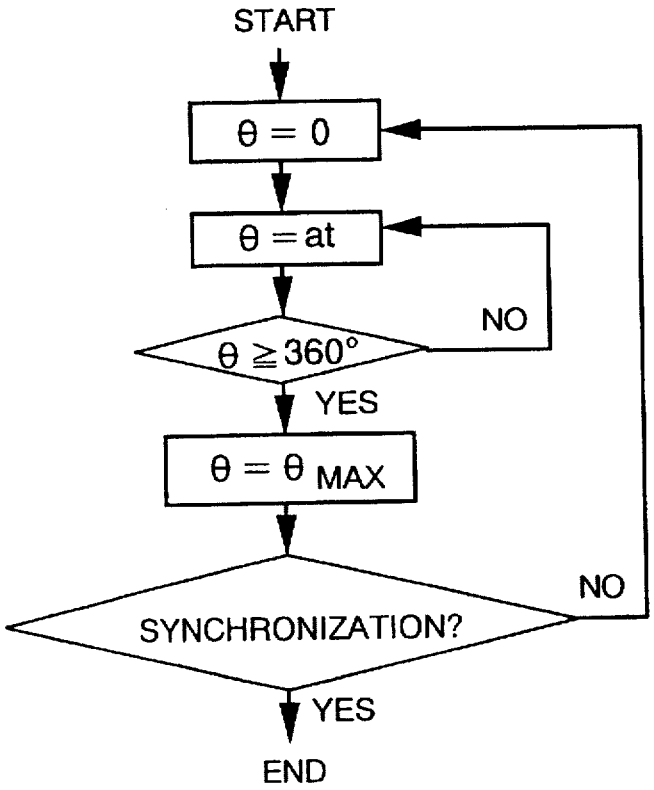
Fig.12 CONVENTIONAL ART
FIG. 12 shows a flowchart illustrating an operating sequence of conventional antenna initial pointing.

With respect to antenna pointing discussed in the previous embodiments, a similar performance may be expected with the replacement of a continuous wave (CW) detector for power detector 4a. FIG. 10 shows a block diagram of an antenna pointing apparatus according to a third embodiment of the present invention. The antenna pointing apparatus of FIG. 10 modifies that of FIG. 2 with the replacement of power detector 4a by a CW detector 12 for detecting an unmodulated carrier wave. CW detector 12 detects the amount of deviation of an unmodulated carrier wave from the accepted standards of frequency and the received level of the IF signal from downconverter 9. CW detector 12 with a received unmodulated carrier wave outputs a similar detected result in terms of received level and frequency deviation to those of power detector 4a as the power-angle chart of FIG. 3 shows.

In this embodiment, antenna 3 receives an unmodulated pilot signal from a communication satellite. CW detector 12 detects the amount of deviation of the unmodulated pilot signal and the received level of the signal, the results of which are output to controller 10. Based on the results, controller 10 controls antenna 3 to point to a marked satellite in a direction having a maximum received level. After pointing the antenna to a satellite, controller 10 gives synthesizer 11 a value designating the amount of deviation of the signal so as to control downconverter 9 to output an IF signal having zero deviation from the accepted standards of frequency. The angle detection of maximum receive level of a pilot signal in this embodiment is similar to the maximum power detection of the previous embodiments and will not be discussed here in further detail.

With further reference to the embodiments of the present invention, the method and apparatus of antenna initial pointing are designed to bring an efficient result especially with a carrier wave which deviates from the accepted standards of frequency of the noise sensitive power detector. This also applies to a situation with a signal having frequency deviations caused by unstable performance of a reference oscillator provided in a synthesizer. The present invention thus requires no reference oscillator or synthesizer higher in quality to bring an efficient and effective achievement in precision and stability of antenna initial pointing, thereby contributing to low-cost manufacturing and high market competitiveness.

Having thus described several particular embodiments of the invention, various alternatives, alterations, modifications, and improvements will readily occur to those skilled in the art. Such alternatives, alterations, modifications, and improvements are intended to be part of the present invention, and therefore fall within the spirit and scope of the invention. Accordingly, the foregoing description is by way of example only, and is not intended to be limiting. The invention is limited only as defined in the following claims and the equivalents thereto.

What is claimed is:

1. An antenna initial pointing apparatus, comprising:

a directionally adjustable antenna for being pointed at a communication satellite;

a synthesizer for generating a local signal of a first frequency so that a receive signal at the directionally adjustable antenna is downconverted into an intermediate frequency (IF) signal;

a power detector for detecting a power level of the IF signal; and a controller for controlling the synthesizer to generate a local signal of a second frequency displaced in frequency from the first frequency in response to the power detector failing to detect a sufficient power level, and for controlling the pointing of the directionally adjustable antenna.

2. The antenna initial pointing apparatus of claim 1, wherein the power detector detects an optimal power level.

3. The antenna initial pointing apparatus of claim 2, wherein the power detector measures a mean power level.

4. The antenna initial pointing apparatus of claim 1 in a receiver, the antenna initial pointing apparatus being in combination with a transmit/receive circuit for transmitting/receiving the receive signal through the antenna.

5. The antenna initial pointing apparatus of claim 4, wherein the transmit/receive circuit is carried on a vehicle used in a satellite communication system.

6. An antenna initial pointing method having a power detector for detecting an optimal reception level of power within a predetermined bandwidth of an intermediate frequency signal downconverted from a receive signal at an antenna based on a local signal, and a controller for controlling antenna pointing and for controlling the local signal in case of failing to detect the optimal reception level, the method comprising the steps of:

setting a first frequency of the local signal and rotating the antenna for detecting the optimal reception level;

setting a second frequency of the local signal lower than the first frequency setting and rotating the antenna for detecting the optimal reception level in case of a failure to detect the optimal reception level in the first frequency setting; and setting a third frequency of the local signal higher than the first frequency setting and rotating the antenna for detecting the optimal reception level in case of a failure to detect the optimal reception level in the first frequency setting.

7. The antenna initial pointing method of claim 6, wherein the second frequency setting raises the frequency of the local signal by a bandwidth equal to the predetermined bandwidth of the power detector.

8. The antenna initial pointing method of claim 6, wherein the third frequency setting lowers the frequency of the local signal by a bandwidth of the power detector.

9. The antenna initial pointing method of claim 6, wherein the setting of the local signal in the second frequency setting raises the frequency of the local signal by a bandwidth narrower than the predetermined bandwidth of the power detector.

10. The antenna initial pointing method of claim 6, wherein the setting of the local signal in the third frequency setting lowers the frequency of the local signal by a bandwidth narrower than the predetermined bandwidth of the power detector.

11. An antenna initial pointing method having a power detector for detecting an optimal reception level of power within a predetermined bandwidth of an intermediate frequency signal downconverted from a receive signal at an antenna based on a local signal, and a controller for controlling antenna pointing and for controlling the local signal in case of failing to detect the optimal reception level, the method comprising the steps of;

setting a first frequency of the local signal by a half shift from the predetermined bandwidth, and rotating the antenna for detecting the optimal reception level; and setting a second frequency of the local signal by another half shift from the predetermined bandwidth, and rotating the antenna for detecting the optimal reception level.

12. An antenna initial pointing method having a power detector for detecting an optimal reception level of power in a predetermined bandwidth of an intermediate frequency (IF) signal downconverted from a receive signal at an antenna based on a local signal, and a controller for controlling antenna pointing to a plurality of predetermined angles and for controlling the frequency of the local signal in case of a failure to detect the optimal reception level, the method comprising the steps of:

detecting power of the intermediate frequency signal by changing the frequency of said local signal at each of said plurality of predetermined angle, until the power detector detects the optimal reception level of power.

* * * * *